US006950062B1

(12) United States Patent
Mather et al.

(10) Patent No.: US 6,950,062 B1
(45) Date of Patent: Sep. 27, 2005

(54) METHOD AND STRUCTURE FOR PHASED ARRAY ANTENNA INTERCONNECT USING AN ARRAY OF SUBSTRATE SLATS

(75) Inventors: John C. Mather, Cedar Rapids, IA (US); Christina M. Conway, Cedar Rapids, IA (US); James B. West, Cedar Rapids, IA (US)

(73) Assignee: Rockwell Collins, Cedar Rapids, IA (US)

( * ) Notice: Subject to any disclaimer, the term of this patent is extended or adjusted under 35 U.S.C. 154(b) by 47 days.

(21) Appl. No.: 10/273,459

(22) Filed: Oct. 18, 2002

(51) Int. Cl.[7] ..... H01P 1/18; H01Q 3/36

(52) U.S. Cl. ..... 342/372; 342/375; 333/156; 333/161

(58) Field of Search ..... 333/156, 161, 333/164; 342/372, 375

(56) References Cited

U.S. PATENT DOCUMENTS 5,170,140 A * 12/1992 Lowe ..... 333/161 X
5,309,165 A 5/1994 Segal et al. ..... 343/770
5,309,166 A * 5/1994 Collier et al. ..... 333/156 X
5,426,403 A * 6/1995 LaLau et al. ..... 333/238
5,786,792 A 7/1998 Bellus et al. ..... 343/770
5,845,391 A 12/1998 Bellus et al. ..... 29/600
6,552,691 B2 4/2003 Mohuchy et al. ..... 343/770
6,650,291 B1 * 11/2003 West et al. ..... 342/311
6,756,866 B1 * 6/2004 Higgins ..... 333/157

OTHER PUBLICATIONS

"Characteristics of Ka Band Waveguide Using Electromagnetic Crystal Sidewalls", by J. A. Higgins et al., 2002 IEEE MTT-S International Microwave Symposium, Seattle, WA, Jun. 2002.

* cited by examiner

*Primary Examiner*—Benny T. Lee
(74) *Attorney, Agent, or Firm*—Nathan O. Jensen; Kyle Eppele

(57) ABSTRACT

A phased array antenna is formed from an array of apertures having walls containing phase shifter devices for phase shifting and beam steering a radiated beam of the phased array antenna. The phase shifter devices are interconnected with an interconnect structure formed from substrate slats that form the walls of the apertures. The substrate slats may be thin film circuitized column slats having a metal substrate, dielectric layers, metal bias/control circuitry, a shielding layer, and circuit terminations to connect to a phase shifter device attached to the substrate slat.

19 Claims, 9 Drawing Sheets

METHOD AND STRUCTURE FOR PHASED ARRAY ANTENNA INTERCONNECT USING AN ARRAY OF SUBSTRATE SLATS

GOVERNMENT RIGHTS

This invention was made under Government contract No. CAAD19-01-9-001 awarded by DARPA. The Government may have certain rights in the invention.

CROSS REFERENCE TO RELATED APPLICATIONS

The present application is related to co-filed application Ser. No. 10/273,872 filed on an even date herewith entitled "A Construction Approach for an EMXT-Based Phased Array Antenna" invented by John C. Mather, Christina M. Conway, James B. West, Gary E. Lehtola, and Joel M. Wichgers. The co-filed application is incorporated by reference herein in its entirety. All applications are assigned to the assignee of the present application.

BACKGROUND OF THE INVENTION

This invention relates to antennas, phased array antennas, and specifically to a method and structure for interconnecting elements of a phased array antenna.

Phased array antennas offer significant system level performance enhancement for advanced communications, data link, radar, and satellite communications (SATCOM) systems. The ability to rapidly scan the radiation pattern of the array allows the realization of multi-mode operation, LPI/LPD (low probability of intercept and detection), and A/J (antijam) capabilities. One of the major challenges in phased array design is to provide a cost effective and environmentally robust interconnect scheme for the large number of phase shifters within the phased array assembly.

It is well known within the art that the operation of a phased array is approximated to the first order as the product of the array factor and the radiation element pattern as shown in Equation 1 for a linear array 10 of FIG. 1 where $E_A(\theta)$ is the radiation pattern of the array as a function of scan angle $\theta$.

Equation 1

$$E_A(\theta) \equiv \underbrace{E_p(\theta,\phi)}_{\text{Radiation Element Pattern}} \underbrace{\left[\frac{\exp\left(-j\frac{2\pi r_o}{\lambda}\right)}{r_o}\right]}_{\text{Isotropic Element Pattern}} \cdot \underbrace{\sum_N A_n \exp\left[-j\frac{2\pi}{\lambda} n\Delta x(\sin\theta - \sin\theta_o)\right]}_{\text{Array Factor}}$$

Standard spherical coordinates are used in Equation 1 and $\theta$ is the scan angle referenced to bore sight of the array 10 in FIG. 1. Introducing phase shift at all radiating elements 15 within the array 10 in FIG. 1 changes the argument of the array factor exponential term in Equation 1, which in turns steers the main beam from its nominal position. Phase shifters are RF devices or circuits that provide the required variation in electrical phase. Array element spacing, $\Delta x$ or $\Delta y$ of FIG. 1, is related to the operating wavelength and it sets the scan performance of the array 10. All radiating element patterns are assumed to be identical for the ideal case where mutual coupling between elements does not exist. The array factor describes the performance of an array 10 of isotropic radiators 15 arranged in a prescribed grid as shown in FIG. 1 for a two-dimensional rectangular array grid 10.

To prevent beam squinting as a function of frequency, broadband phased arrays utilize true time delay (TTD) devices rather than traditional phase shifters to steer the antenna beam. Expressions similar to Equation 1 for the TTD beam steering case are readily available in the literature.

The isotropic radiation element 15 in FIG. 1 has infinitesimal dimensions, as explained in subsequent paragraphs. The spacing of the isotropic radiators 15 determines the scan performance of the phased array 10. The elements 15 must be spaced less than or equal to one half wavelength ($\lambda_o/2$) apart for the radiated pattern to be free from grating lobes. Grating lobes are false undesired beams having strength equal to the main beam. The wider the element spacing, $\Delta x$ or $\Delta y$, the smaller the grating lobe-free scan volume is for the array 10. Array factors are also available for 2-D and 3-D phased arrays having rectangular and hexagonal grid arrangements, but they are not discussed here for the sake of brevity.

The isotropic radiating element 15 is an infinitesimally small, nonphysical mathematical concept that is useful for array analysis purposes. On the other hand, all operational arrays utilize physical radiating elements 25 of finite size as shown in the array 20 of FIG. 2. Radiating element size in the plane of a planar array, or along the array surface for a conformal array, is usually a large fraction of $\lambda_o/2$, as required for efficient radiation. Since the array spacing, $\Delta x$ or $\Delta y$, sets the grating lobe-free scan volume of the array 20, it also puts restrictions on the transverse size of the individual radiating elements 25 within the array 20. The extremities of neighboring radiating elements 25 are frequently very close to one another and in some cases, the array spacing, $\Delta x$ or $\Delta y$, prevents certain types of radiating elements 25 from being used.

A comparison of FIGS. 1 and 2 illustrates how real, physical radiating elements 25 consume the majority of the surface area around the array grid intersection points. The array element spacing, $\Delta x$ or $\Delta y$, and transverse size restrictions are further exacerbated in electronically scanned phased arrays. The most general two-dimensional, or three-dimensional (arbitrarily curved surface) electrically scanned phased array antennas require phase shifters at each radiating element 25 to electronically scan the main beam of the radiation pattern. A very space-efficient interconnect cable assembly is required to provide the proper control signals, bias and chassis ground to each individual radiating element 25 and the phase shifters (not shown). However, the physical size of the cabling assembly is often too large and cumbersome to effectively route around the array radiating elements 25 without perturbing the RF field of the radiating element 25 and/or the aggregate field of the sub-array or top-level array assemblies.

What is needed is an interconnect scheme for phased array antennas that is low profile and high density and allows it to be embedded within the phased array structure.

SUMMARY OF THE INVENTION

A phased array antenna with a plurality of phase shifter elements for phase shifting and beam steering a radiated beam of the phased array antenna is disclosed. The phase shifter elements are interconnected with an interconnect structure comprising a plurality of substrate slats that form walls of the phased array antenna. Each of the substrate slats has a metal substrate for supporting the substrate slat. A first dielectric layer is applied to the metal substrate in selected areas. Metal bias/control circuitry is applied to the selected areas on the first dielectric layer. A second dielectric layer is applied over the bias/control circuitry. A shielding metal layer is applied over the second dielectric layer. Circuit terminations are connected to the metal bias/control circuitry for control signals and bias voltages and to the shielding metal layer for a ground connection. A phase shifter device is attached to the substrate slat and connected to the circuit terminations and is used for phase shifting and beam steering the radiated beam of the phased array antenna. Additional circuit terminations are connected to the metal bias/control circuitry and the shielding metal layer for receiving supply voltages and phase shifter control signals from an external beam steering computer.

The substrate slat may have a connection between the shielding layer and the metal substrate formed by a path through the first dielectric layer and the second dielectric layer. The circuit terminations may be located on the same side of the substrate slat as the metal bias/control circuitry. Alternately, the circuit terminations may be located on a side opposite of the metal bias/control circuitry on the substrate slat.

The phase shifter device may be attached to the substrate slat by solder bump connections to the circuit terminations. Alternately the phase shifter device may be attached to the substrate slat with a bonding method and wirebond connections are made to the circuit terminations. The bonding method may be an adhesive bonding method or a metallurgical bonding method.

The phase shifter device may be a digital phase shifter and may be a true time delay device, MEMS switched line, high pass/low pass, reflection, reactive loaded line and a latching ferrite.

The phase shifter device may be an analog phase shifter and may be an MMIC FET, varactor microstrip, varactor stripline, ferrite microstrip, ferro microstrip, ferrite stripline, ferro stripline, EMXT sidewall, reciprocal ferrite, ferroelectric, and latching ferrite.

It is an objective of the present invention to eliminate the need for bulky and complicated bias and control wiring harnesses for a phased array antenna.

It is an objective of the present invention to orient the bias/control wiring so its thickness, rather than its width, is in the space between radiating elements of a phased array antenna.

It is an advantage of the present invention to be applicable to a wide range of phased array antenna topologies and phase shifter architectures.

It is an advantage of the present invention to create vertical and horizontal interconnect schemes for two-dimensional and three-dimensional (generally conformal) array architectures.

It is a feature of the present invention to offer an interconnect scheme reliability improvement because part of the control circuitry can be embedded within the array, reducing the conductor count between the beam steering computer and the phased array.

BRIEF DESCRIPTION OF THE DRAWINGS

The invention may be more fully understood by reading the following description of the preferred embodiments of the invention in conjunction with the appended drawings wherein.

DETAILED DESCRIPTION OF THE INVENTION

Figure 1:
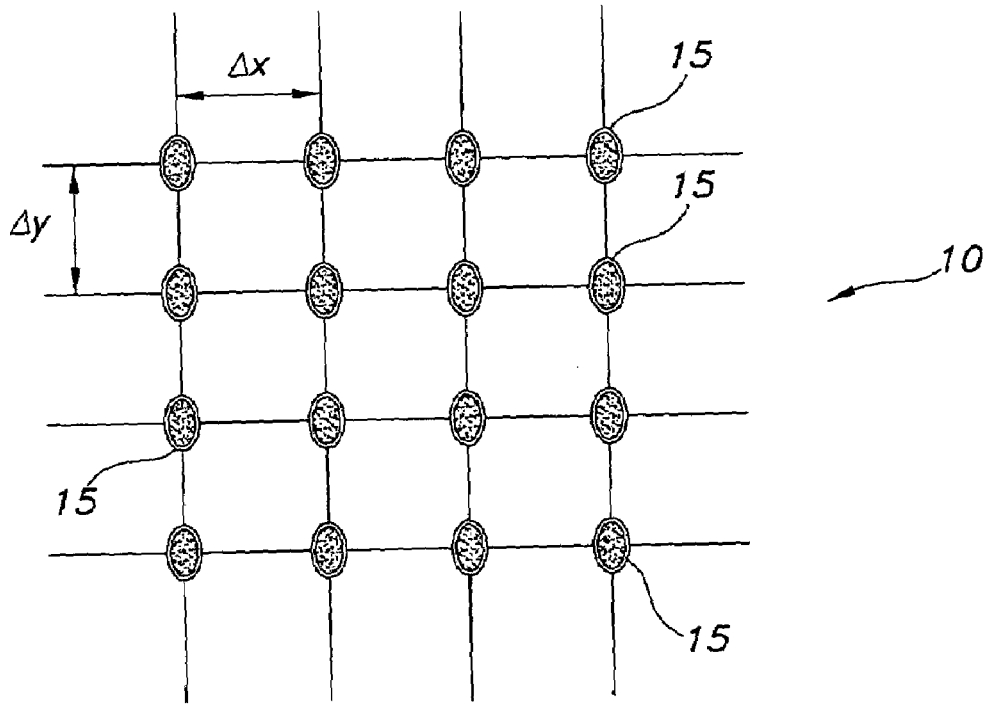
FIG. 1 (PRIOR ART)
FIG. 1 is a diagram of a rectangular 2-D planar phased array isotropic element grid.
Figure 2:
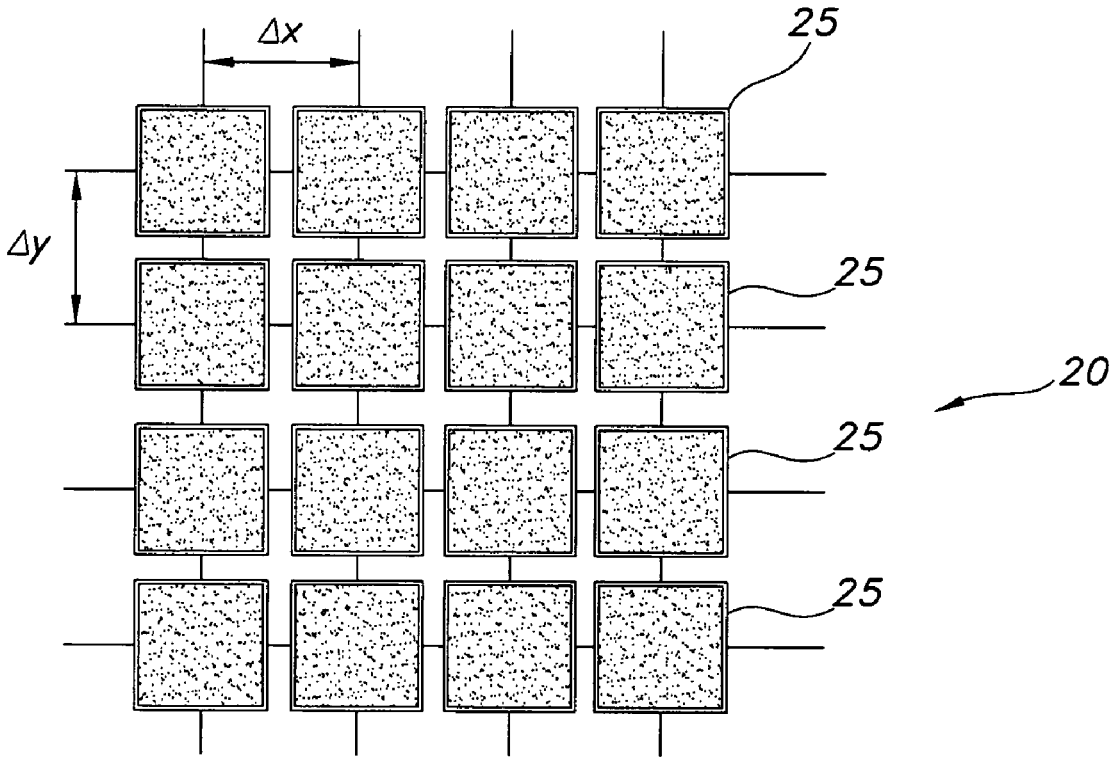
FIG. 2 (PRIOR ART)
FIG. 2 is a diagram of a rectangular 2-D planar phased array physical radiating element grid.
Figure 3:
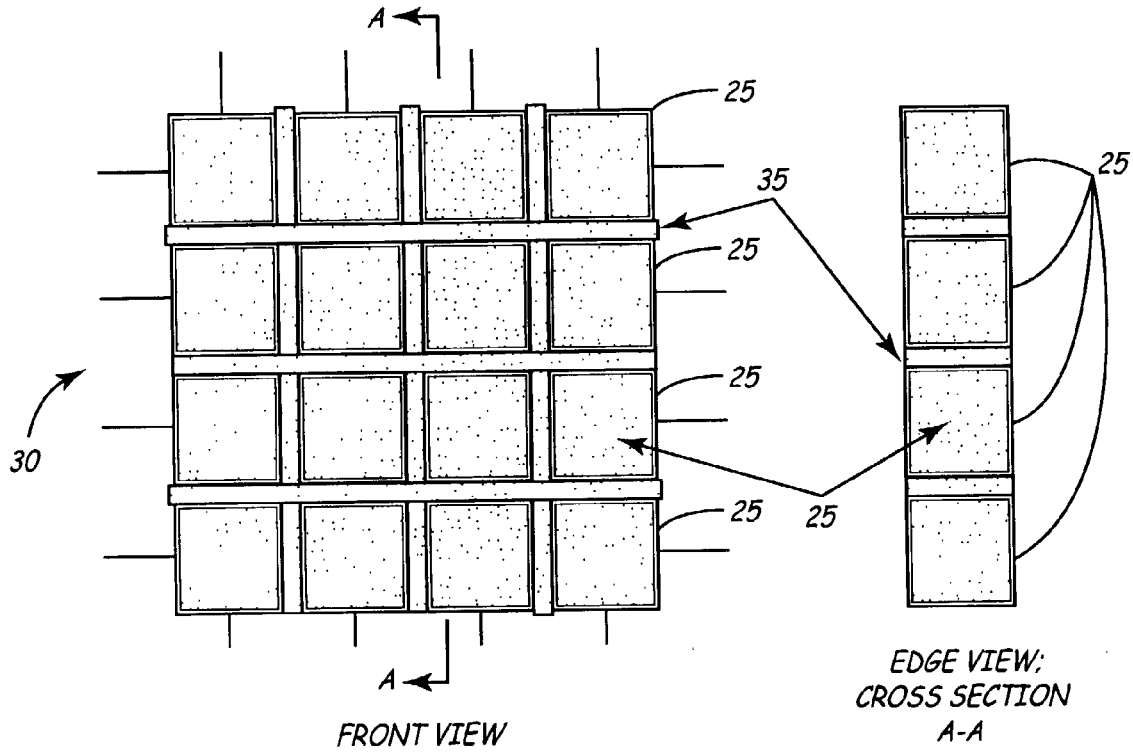
FIG. 3 is a diagram of a rectangular 2-D planar phased array interconnect scheme of the present invention.

The invention described herein effectively resolves the phased array interconnect problem by utilizing fine pitch, high-density circuitry in a thin self-shielding multi-layer printed wiring assembly. The new approach utilizes the thickness dimension of an array aperture wall (parallel to bore sight axis) to provide the surface area and volume required to implement all of the conductive traces for phase shifter bias, ground, and control lines. The thickness of the printed wiring assemblies 35 are now in the x-y plane (front view) of the radiating elements 25 in the phased array 30 as shown in FIG. 3.

Figure 4:
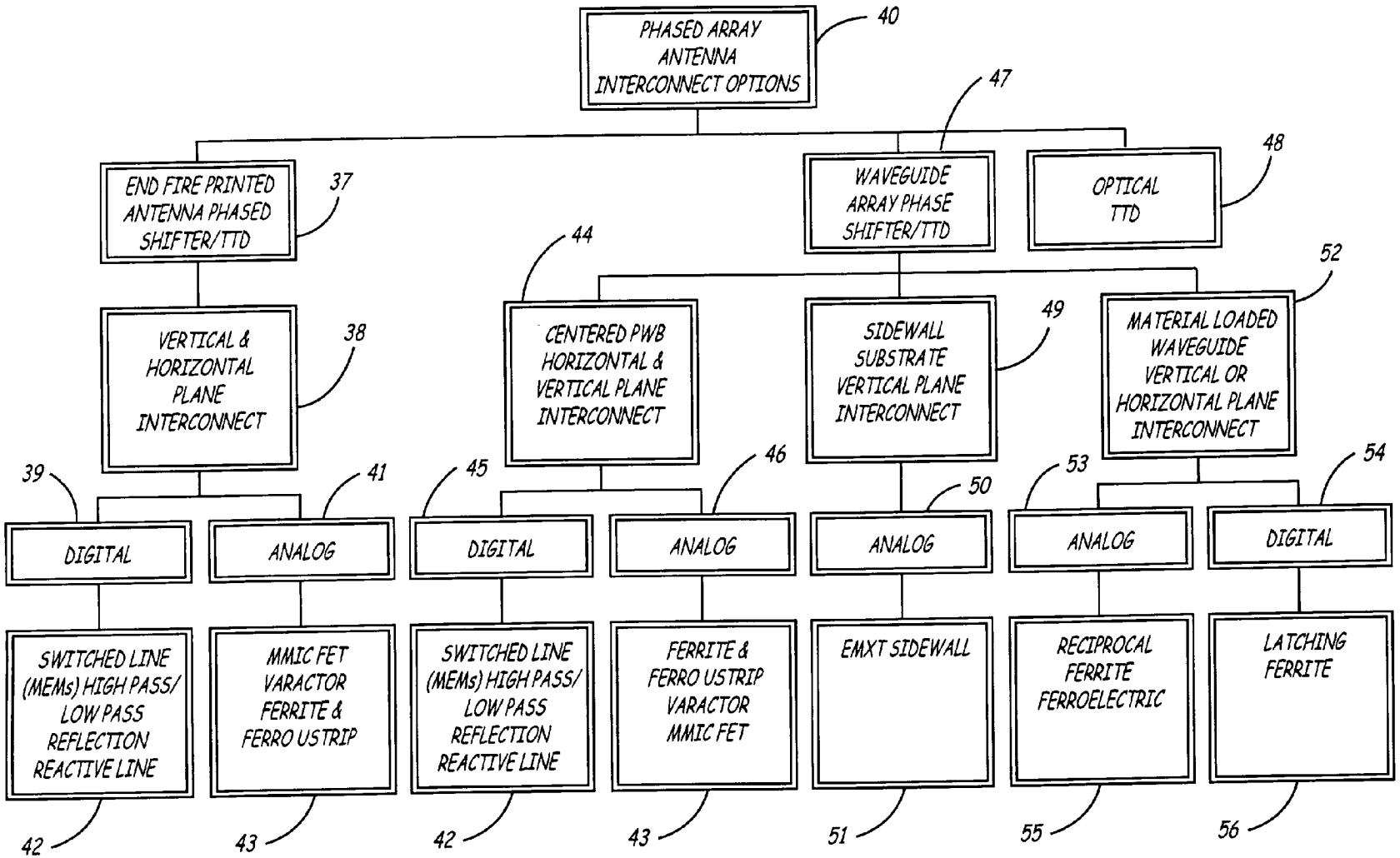
FIG. 4 is a diagram showing the circuitized interconnect scheme phased array application space.

The phased array antenna interconnect concept described herein has wide ranging utility for several classes of existing and next generation RF/microwave/millimeter wave phase shifter technologies. FIG. 4 illustrates phased array antenna interconnect options 40 for a wide potential phase shifter application space for this invention. End fire printed antenna radiating elements or waveguide radiating elements may be used.

Figure 6:
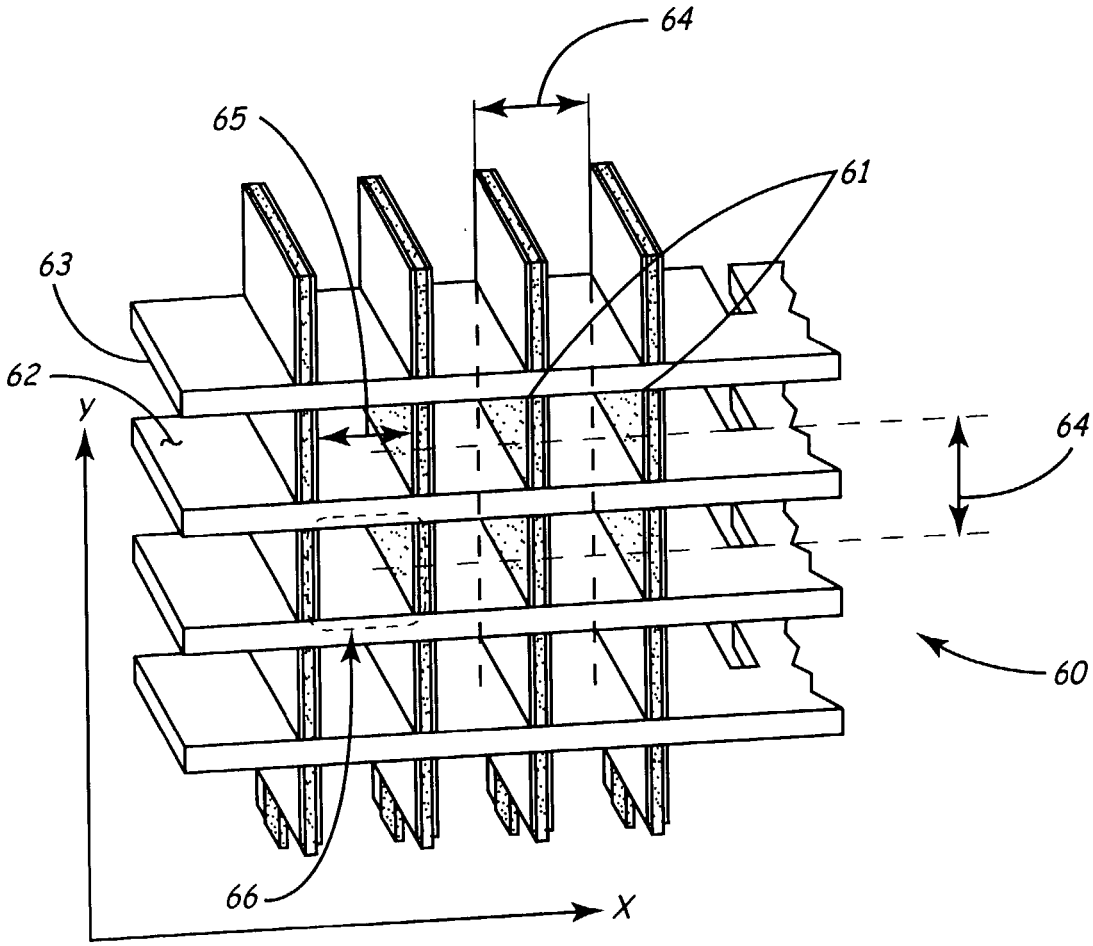
FIG. 6 is a diagram of a phased array antenna having multiple active elements in an X-by-Y configuration.

In an end fire array, end fire radiating elements may be disposed on four walls in a square configuration with parallel pairs of walls and with an open input end and an open radiating end similar to a waveguide array shown in FIG. 6. Space feeds, semi-constrained feeds, or constrained array feeds may be used to excite the array. End-fire radiating elements are located on inner surfaces and on outer surfaces of the four walls. The outer surface end-fire radiating elements serve as inner surface radiating elements for adjacent unit cells. The end fire radiating elements may be quasi-Yagi radiators or notch radiators such as antipodal notches or Vivaldi notches. End fire printed antenna interconnect options include using phase shifters or true time delay devices as indicated by block 37 in vertical and horizontal planes (block 38). The phase shifters in the end fire printed antenna may be digital 39 or analog 41 phase shifters. Phase shifters in the digital category 39 include a MEMS (micro electromechanical system) switched line, high pass/low pass, reflection, or reactive loaded lines as indicated in block 42. Analog phase shifters (block 41) may also be utilized in end fire antennas. The analog phase shifters 41 include MMIC (monolithic microwave integrated circuits) FET (field effect transistors), varactors, and ferrite or ferro microstrip or stripline as indicated in block 43 in FIG. 4. The end fire printed antenna 37 phase shifter options may be implemented either as monolithic microwave integrated circuits (MMICs) or with discrete active microwave devices integrated into high density printed wiring module assemblies.

The waveguide phased array antenna is made up of an array of waveguides located adjacent to each other as shown in FIG. 6. The waveguide phased array antenna interconnect options include array phase shifters or true time delay devices as indicated by block 47. Three waveguide phase shifter interconnect options are shown in FIG. 4.

The first option is a PWB (printed wiring board) centered in the waveguide in horizontal or vertical planes (block 44). Again digital 45 and analog 46 phase shifter options exist. In the digital 45 category, the same type of phase shifters may be used as with the end fire printed antenna as indicted by block 42. In the analog (block 46) category, the same type of phase shifters may be used as with the end fire antenna as indicated by block 43. The centered PWB 44 options in FIG. 4 can also be implemented either as monolithic microwave integrated circuits (MMICs) or with discrete active microwave devices integrated into high density printed wiring module assemblies.

The second waveguide phase shifter interconnect option is for phase shifter substrates on the waveguide sidewalls in a vertical plane as indicted by block 49. Analog (block 50) category phase shifters include EMXT (electromagnetic crystal) sidewall phase shifters (51). EMXT devices are also known as tunable photonic band gap (PBG) and tunable electromagnetic band gap (EBG) substrates in the art. A detailed description of a waveguide section with tunable EBG phase shifter technologies is available in a paper by J. A. Higgins et al. "Characteristics of Ka Band Waveguide using Electromagnetic Crystal Sidewalls" 2002 IEEE MTT-S International Microwave Symposium, Seattle, Wash., June 2002.

The third waveguide phase shifter interconnect option is for material loaded waveguides with interconnect either in a vertical or horizontal plane (block 52). Analog 53 category phase shifters include reciprocal ferrite or ferroelectric phase shifters as shown by block 55. Digital 54 phase shifters include latching ferrite devices as shown by block 56.

While it is understood that FIG. 4 is not exhaustive, the figure is intended to illustrate the broad, general applicability of the invention. The term phase shifter and phase shifter device used throughout in the following description and appended claims encompasses true time delay devices (TDD) and all phase shifter technologies both analog and digital disclosed in FIG. 4.

Figure 5:
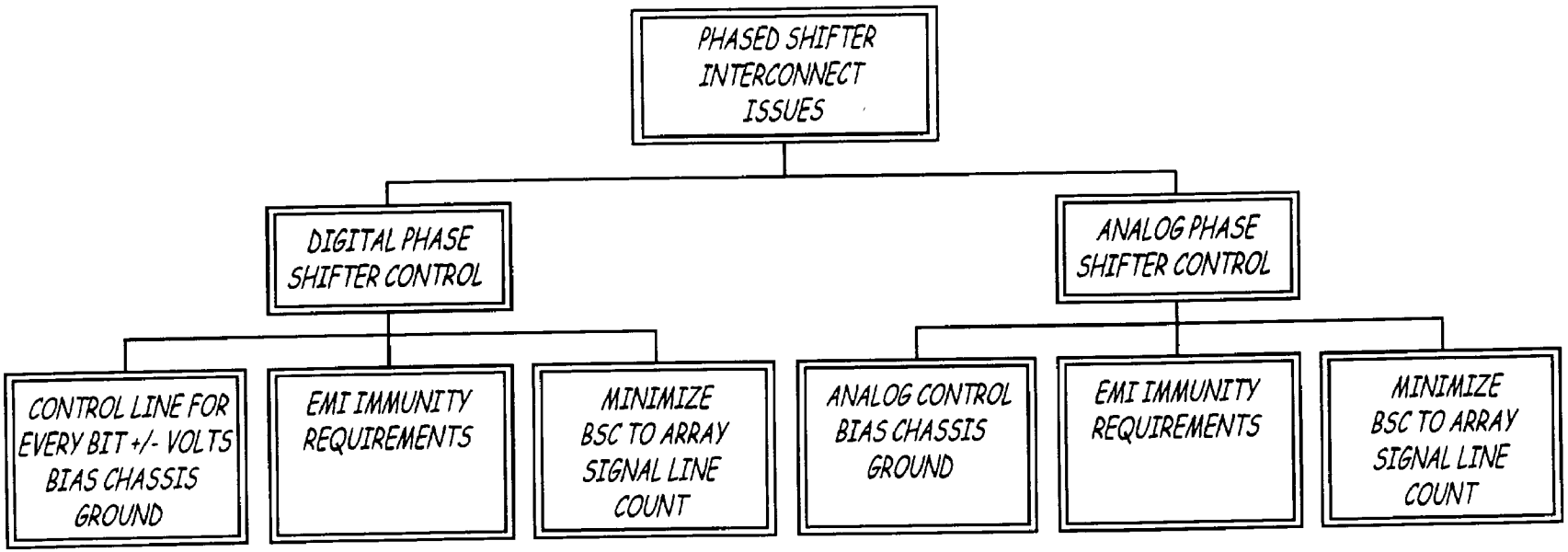
FIG. 5 is a diagram showing digital vs. analog phase shifter interconnect requirements.

The phase shifters described in FIG. 4 can be grouped into two main categories comprising digital phase shifters and analog phase shifters as shown in FIG. 5. As shown in FIG. 5, each type of phase shifter has different bias and control signal requirements.

Digital phase shifters are typically controlled with a parallel bus with a control line count equal to the number of bits in the phase shifter. For example, a 5-bit phase shifter needs five control lines plus ± voltage lines and chassis ground. Also, since an electrically large phased array requires an enormous amount of digital control data, a serial bus is typically used between a beam steering computer (BSC) and the phased array, with a serial-to-parallel translation occurring at the radiating element level. An additional feature of this invention is that the serial-to-parallel bus translation can occur by means of embedded digital circuitry within the interconnect assembly 35 of FIG. 3 to reduce the conductor count between the beam steering computer and the phased array assembly.

The analog class of phase shifters in FIG. 5 requires either continuously variable voltages or currents for phase shifting control. Digital-to-analog converters are required to convert the digital control signals from the beam steering computer. Similar to the above, D/A converters can be embedded within the interconnect assembly 35 to reduce the conductor count between the beam steering computer and the phased array assembly.

The subsequent detailed descriptions of the invention embodiments emphasize microwave and millimeter wave phase shifting and true time delay (TTD) technologies along with conventional printed wiring board metallic interconnect lines. Note that this invention can be generalized to include optical circuit interconnect, block 48 in FIG. 4, by embedding optical waveguide and RF-to-optical conversion within the assembly 35. In addition, optical-based digital signal processing (DSP) and true time delay can ultimately be possible with this invention with advances in electro-optic technology.

Given the above, the packaging and interconnect challenge is to create an interconnect scheme to deliver electrical signals to each phase shifting device/circuit in a phased array antenna (or an antenna sub-array) having multiple (even hundreds or thousands) active elements. For simplicity and clarity, the present interconnect invention is discussed in detail by describing its application to a specific implementation. Extension and scalability of the ideas from this specific example to other situations should then be readily apparent to those skilled in the art.

The specific implementation example is an EMXT (electromagnetic crystal)-based phased array antenna using waveguide radiating elements operating at 38 GHz as represented by block 51 in FIG. 4. A sixteen-element proof-of-concept antenna 60 shown in FIG. 6 is described. In this embodiment, the sixteen elements are arranged in a 4×4 square matrix. As indicated in FIG. 6, each array element 66 is comprised of EMXT device 61 sidewalls and a conductive (metallic) floor 62 and ceiling 63. Each EMXT device 61 requires unique bias voltage and ground connections (not shown). The maximum permitted distance 64 between centerlines of adjacent apertures is $\lambda_o/2$ in both the X and Y directions. It is desirable that the distance 65 separating opposing EMXT faces be essentially as large as possible within the $\lambda_o/2$ limit, implying that the total thickness of the EMXT 61 plus mounting structure and interconnect must be minimized.

Figure 7:
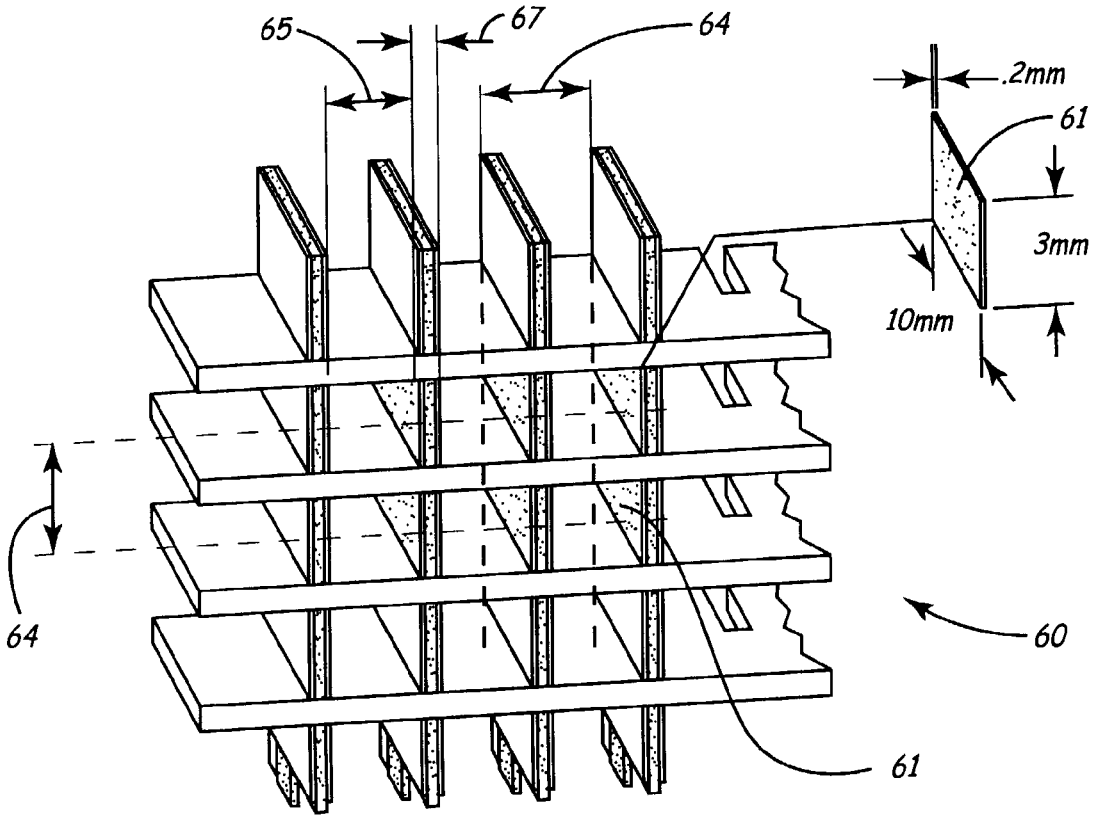
FIG. 7 is diagram of the phased array antenna of FIG. 6 with example dimensions for a 38.5-GHz antenna.

To illustrate some representative dimensions, an example beam former antenna operating at 38.5 GHz is shown in FIG. 7. At 38.5 GHz the half wavelength ($\lambda_o/2$) 64 is 3.89 mm. The distance separating opposing EMXT faces should be approximately 3 mm. Representative EMXT device 61 dimensions are 3 mm wide×10 mm long×0.2 mm thick. Given the above, approximately 0.89 mm (0.035") is the total remaining dimension 67 available for the thickness of two EMXT devices 61 (0.2 mm×2=0.4 mm), plus means for attaching the two EMXT devices 61 to the mounting structure (~0.075 mm×2= ~0.15 mm), plus related mounting structure and interconnect (~0.34 mm, or 0.0134"). For this example, the EMXT device 61 is assumed to be fabricated on GaAs semiconductor.

Figure 8:
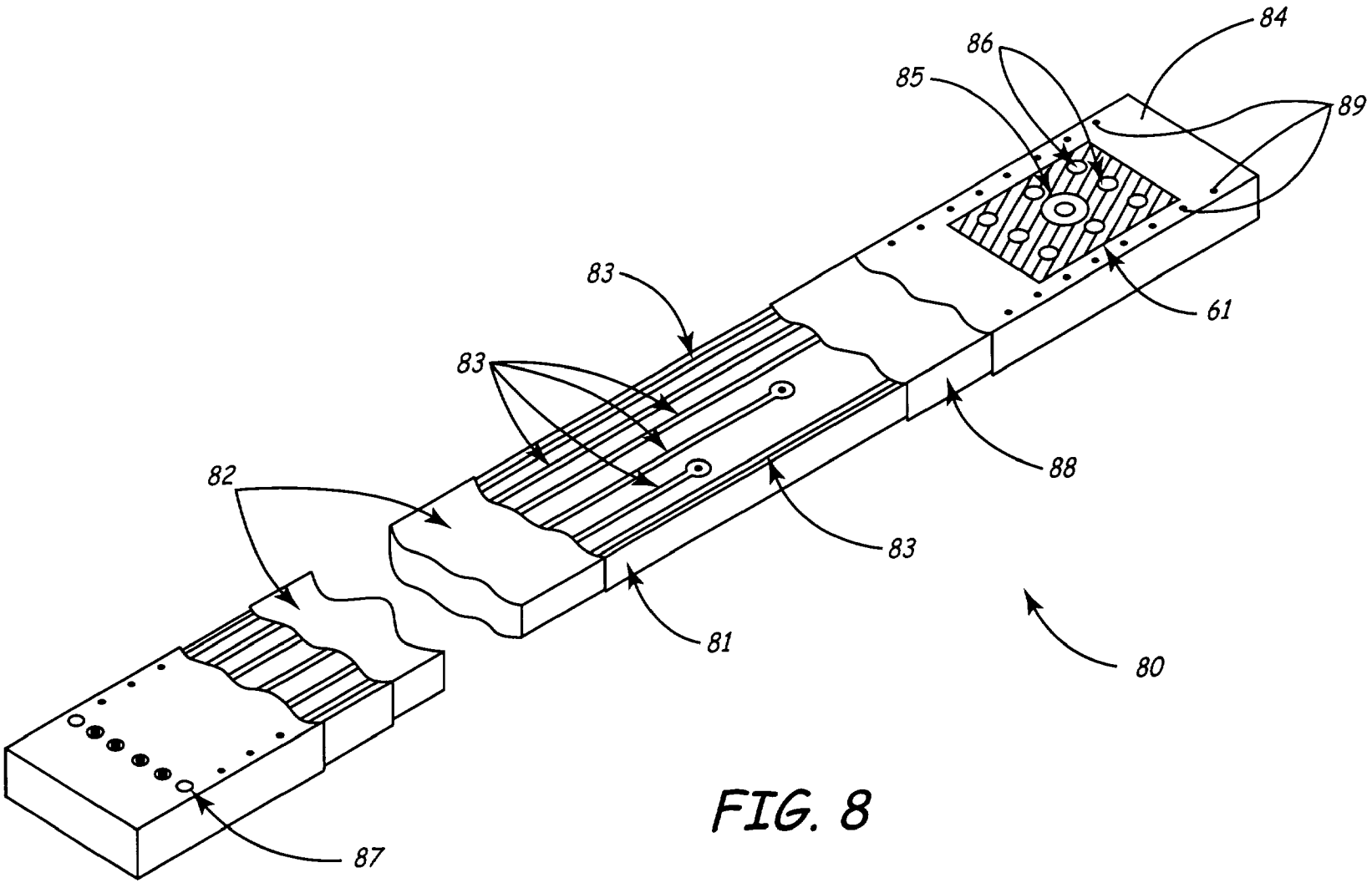
FIG. 8 is a cutaway diagram of a substrate slat of the present invention with shielded circuitry on one side.

A circuitized substrate slat 80 approach for achieving reliable EMXT device 61 (see FIGS. 6 and 7) mounting and providing for an electrically shielded interconnect is described in detail below and illustrated in FIG. 8. The substrate slat 80 forms the walls of the array 60 in FIG. 7. Specific portions and/or features of the circuitized substrate slat 80 are discussed below, in sequence. Note that the concepts presented in FIG. 8 are applicable to all phase shifting and TTD schemes presented in FIG. 4.

A semiconductor-based EMXT device 61 is relatively brittle and fragile. Accordingly, its mounting structure should provide some protection from mechanical shock, flexing, and/or stressing due to expansion/contraction during temperature cycling. The coefficient of thermal expansion (CTE) expansion of the mounting structure should be closely matched to that of the EMXT device 61. Kovar or Alloy 42 would be good choices, having CTE of approximately 5.0 to 5.5 ppm/° C. Thickness in the range of 0.005" is suitable for the mounting structure 80.

To fabricate circuitry, alternating layers of thinfilm dielectric material(s) and metal(s) are deposited and configured (imaged) in sequence. Applicable well-established deposition processes include spinning, curtain coating, vacuum deposition, electrodeposition, and/or electroless deposition. Configuring/imaging processes may include machining (including laser), etching, or the like to remove unwanted material; or deposition through a contact mask so the deposited material reaches the substrate slat 80 only in the desired locations. For some dielectric material types, photosensitive versions are available to facilitate imaging.

An example application sequence for the substrate slat 80 in FIG. 8 might be as follows: start with a metal substrate 82 having the desired thickness and finish. In the antenna, this metal substrate 82 is maintained at ground potential. Apply a first thin layer of dielectric 81 to selected areas as needed to isolate the bias/control circuit metal 83 (next step) from the metal substrate 82. Deposit and image the metal bias/control circuitry 83. Apply a second thin layer of dielectric 88 over the bias/control circuitry 83 as needed to isolate the bias/control circuit 83 metal from a shielding metal layer 84 (next step). Deposit and image the shielding metal layer 84.

It may be desirable to have the shielding layer 84 grounded to the metal substrate 82. One approach is to ensure that dielectric material from the first layer 81 and the second layer 88 is absent from selected areas on the metal substrate 82 prior to deposition of the shielding layer 84, so the electrical connection to the metal substrate 82 is made during shielding layer 84 deposition. This connection path can be accomplished in a continuous manner or through a series of closely spaced small holes 89 that are formed in the dielectric layers 81 and 88 using a laser ablation process or some alternate method. Coatings/circuitry can be applied to one or both sides of a substrate slat 80, as required.

The location of circuit terminations 85 and 86 for electrical connection to the EMXT device 61 can be on either side of the substrate slat 80. Terminations 85 and 86 may be on the same side of the substrate slat 80 as the shielded bias/control circuitry 83. An opening in the shielding layer may be required to reveal each electrically isolated bias pad 85. Ground connections 86 may be made directly to the shielding metal substrate 82.

Terminations 85 and 86 may be on the side of the substrate slat 80 opposite the shielded bias/control circuitry 83. Ground connections 86 may be made directly to the metal substrate 82. Bias connections 85 require a via through the substrate 80 and electrical isolation from the metal substrate 82. Metalization of the via can be accomplished during bias/control circuit 83 creation.

Additional circuit terminations 87 may be required elsewhere on the substrate to facilitate attachment of a connector or other means for receiving bias/ground and control signals from a source external to the substrate slat 80.

There are at least two options for EMXT device 61 mechanical attachment and electrical connection. Solder bump attachment to the EMXT device 61 backside may be used to secure the device and accomplish the required ground 86 and bias 85 connections. Underfill of the EMXT device 61 may be used to enhance the attachment ruggedness. Wirebonds to the EMXT device 61 topside for ground 86 and bias 85 connections may be made and a bonding method such as adhesive or metallurgical bonding may be used to attach the device backside to the substrate slat 80. To accomplish this alternative, it may be necessary to extend the metal substrate 82 so the substrate bond pads 85 and 86 lie beyond the periphery of the EMXT device 61. Extending the metal substrate 82 in this manner may have a negative effect on antenna performance.

The overall approach described above permits assembly of devices 61 to one face of a substrate slat 80 or possibly to both faces. If the device 61 attachment is to one face of the substrate slat 80, then device/slat subassemblies may be placed back-to-back without electrical interaction because the bias circuitry 83 is fully enclosed/shielded.

Methods for forming circuits can place the bias connection pads 85 for the EMXT device 61 on either side of the substrate slat 80, either on the circuit 83 side of the slat 80 or on the side of the substrate slat 80 opposite the circuit traces 83. The decision regarding whether to attach the phase shifting devices 61 to the circuit side or to the substrate side may depend on mechanical issues surrounding the application.

The thickness of the circuitized metal substrate 82 is minimized when a thinfilm approach is used. This is particularly attractive for higher frequency antennas where space is at a greater premium because $\lambda_o/2$ decreases with increasing frequency. For the analog EMXT-based phase array being discussed, the bias conductors 83 ideally do not carry any current, so conductor cross section may be quite small. For reference, typical dimensions for this thinfilm approach are as follows. Dielectric layers 61 may range from approximately 1 to 25 $\mu$m (micrometers), depending on the type of material and application method. A typical spin-on polyimide thickness is from approximately 1 to 2 $\mu$m. A typical paraylene-C thickness ranges from 10 to 25 $\mu$m. Parylene is a common generic name for a series of polymer coatings based on paraxylene. Metal layer 83 and 84 thickness could range widely, depending on the need and the method of deposition. Typical thickness from vacuum deposition is about 0.1 to 2 $\mu$m. Typical thickness from electroless deposition is about 0.3 to 3 $\mu$m and typical thickness from electrodeposition is about 1 to 50 $\mu$m. Thus, the entire thickness of a substrate slat 80 with one shielded circuit structure might be about 0.0064". The metal substrate 82 is approximately 127 $\mu$m (0.005"), two dielectric layers 81 at 15 $\mu$m each totals 30 $\mu$m (0.0012") and two metal layers at 2 $\mu$m each total 4 $\mu$m (0.0002") for grand total of 161 $\mu$m (0.0064"). The 0.0064" total meets the target value of approximately 0.013" established for two circuitized substrates. If the metal substrate has shielded circuitry on two sides, the total thickness is about 195 $\mu$m, or less than 0.008".

There is a printed wiring board (pwb) technology alternative to the thinfilm approach delineated above. Very thin pwb circuit materials may be utilized to create the shielded circuitry. One candidate is Kapton polyimide flexible circuit material, which is available in 1- and 2-mil dielectric film thickness and with 0.5-oz (0.0007" thick) copper on each side (total thickness 0.0024" for the 1-mil film version). A circuit may be fabricated so one copper face is the shield layer and the other is the bias/control circuitry. The bias/control side of the circuit would be bonded to the substrate using typical pwb lamination material and processes, yielding a bondline thickness of approximately 0.002". The ground interconnect to the substrate can be achieved using laser ablated blind holes that are then plated to form the connection. The total thickness for a substrate with circuitry on one side would be about 0.010". Note that although the discussion above indicates one layer of bias/control interconnect circuitry, it would be possible to create multiple layers of bias lines with each layer pair being separated by dielectric.

Figure 9:
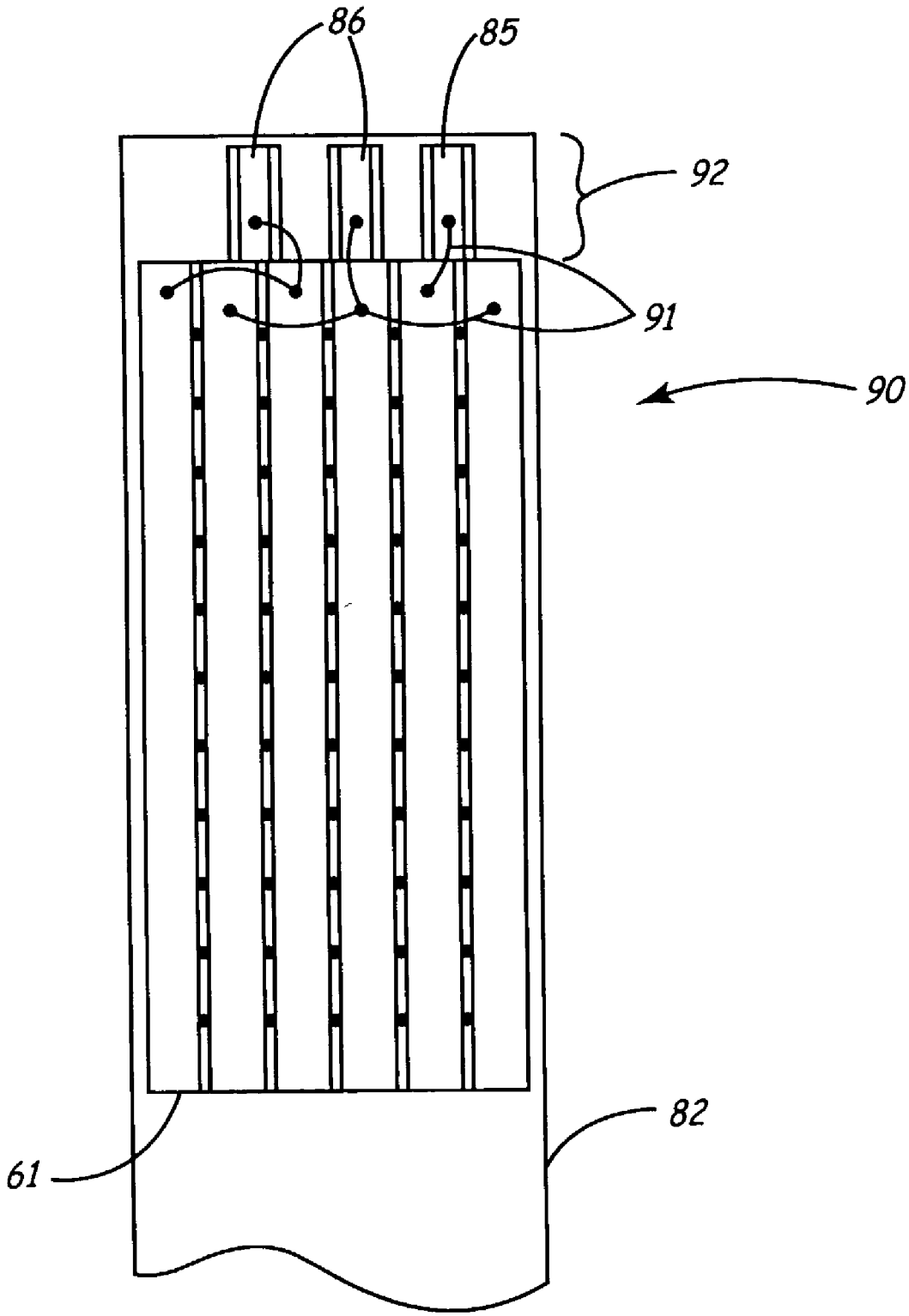
FIG. 9 is a diagram showing wirebonded bias and ground connections from a printed wiring board based interconnect to top face of an InP EMXT device on a substrate slat of the present invention.

FIG. 9 shows an example of wirebonds 91 to bias/control 85 and ground 86 connections from a pwb-based column slat 90 interconnect to the top face of an indium phosphide EMXT phase shifter device 61. Note that a pwb interconnect extension 92 extends beyond the Kovar metal substrate 82, and that for this example the bond pads 85 and 86 are actually on the pwb extension 92.

There are manufacturing and test related advantages to the interconnect methodology presented herein. The important factor is that active devices and/or circuits are assembled on the flat circuitized substrate. Industry standard automated placement and solder reflow attachment of devices can readily be accomplished. Additionally, these populated subassemblies can be DC probed and/or actively tested (e.g., RF reflection test) prior to irreversibly committing the subassembly to a phased array assembly. Individual devices that are found to be defective may be removed and replaced.

Other phase shifter types have current density and voltage bias and control requirements that differ from those required by the EMXT waveguide phase shifters discussed in detail herein. The invention disclosed herein is readily adaptable to these cases.

It is believed that the method and structure for phased array antenna interconnect of the present invention and many of its attendant advantages will be understood by the foregoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. A phased array antenna having a plurality of phase shifter devices for phase shifting and beam steering a radiated beam of the phased array antenna, said plurality of phase shifter devices interconnected with an interconnect structure comprising a plurality of substrate slats forming walls of the phased array antenna, each of said substrate slats comprising:

a metal substrate for supporting the substrate slat;

a first dielectric layer applied to the metal substrate in selected areas;

metal bias/control circuitry applied to the selected areas on the first dielectric layer;

a second dielectric layer applied over the bias/control circuitry;

a shielding metal layer applied over the second dielectric layer;

circuit terminations connected to the metal bias/control circuitry for control signals and bias voltages and to the shielding metal layer for a ground connection;

a respective one of said plurality of phase shifter devices attached to a corresponding one of said plurality of substrate slats and connected to the circuit terminations; and additional circuit terminations connected to the respective metal bias/control circuitry and the shielding metal layer for receiving corresponding supply voltages and phase shifter control signals.

2. The phased array antenna of claim 1 wherein each of said substrate slats further comprises a connection between the shielding layer and the metal substrate formed by a path through the first dielectric layer and the second dielectric layer.

3. The phased array antenna of claim 1 wherein the circuit terminations are located on the same side of each of said substrate slats as the metal bias/control circuitry.

4. The phased array antenna of claim 1 wherein the circuit terminations are located on a side opposite of the metal bias/control circuitry on each of said substrate slats.

5. The phased array antenna of claim 1 wherein the respective phase shifter device is attached to each of said substrate slats by solder bump connections to the circuit terminations.

6. The phased array antenna of claim 1 wherein the respective phase shifter device is attached to each of said substrate slats with a bonding method and wirebond connections are made to the circuit terminations.

7. The phased array antenna of claim 6 wherein the bonding method is an adhesive bonding method.

8. The phased array antenna of claim 1 wherein the respective phase shifter device is a digital phase shifter and is one of the group consisting of a true time delay device, MEMS switched line, high pass/low pass, reflection, reactive loaded line and a latching ferrite.

9. The phased array antenna of claim 1 wherein the respective phase shifter device is an analog phase shifter and is one of the group consisting of an MMIC FET, varactor microstrip, varactor stripline, ferrite microstrip, ferro microstrip, ferrite stripline, ferro stripline, EMXT sidewall, reciprocal ferrite, and ferroelectric.

10. A phased array antenna comprising an array of apertures, said apertures having walls with a plurality of phase shifter devices disposed thereon for phase shifting and beam steering a radiated beam of said phased array antenna, said plurality of phase shifter devices interconnected with circuitry disposed on a plurality of substrate slats forming said walls of said apertures, wherein each of the plurality of substrate slats further comprises printed wiring board column slats, each of said printed wiring board column slats further comprising:

a metal substrate for supporting the substrate slat;

a printed wiring board having metal on two sides of a dielectric film wherein one side is a shield layer and the other side is a bias/control circuit layer wherein said printed wiring board bias/control layer is bonded to the metal substrate;

circuit terminations connected to the bias/control circuit layer for control signals and bias voltages and to the shield layer for a ground connection; and a respective one of said plurality of phase shifter devices attached to a corresponding one of said plurality of substrate slats and connected by wirebonds to the circuit terminations.

11. A phased array antenna comprising an array of apertures, said apertures having walls with a plurality of phase shifter devices disposed thereon for phase shifting and beam steering a radiated beam of said phased array antenna, said plurality of phase shifter devices interconnected with circuitry disposed on a plurality of substrate slats forming said walls of said apertures, wherein each of the plurality of substrate slats further comprise:

a metal substrate for supporting the substrate slat;

a first dielectric layer applied to the metal substrate in selected areas;

metal bias/control circuitry applied to the selected areas on the first dielectric layer;

a second dielectric layer applied over the bias/control circuitry;

a shielding metal layer applied over the second dielectric layer;

circuit terminations connected to the metal bias/control circuitry for control signals and bias voltages and to the shielding metal layer for a ground connection;

a respective one of said plurality of phase shifter devices attached to a corresponding one of said plurality of substrate slats and connected to the circuit terminations; and additional circuit terminations connected to the respective metal bias/control circuitry and the shielding metal layer for receiving corresponding supply voltages and phase shifter control signals from an external beam steering computer.

12. A method of fabricating each substrate slat in a plurality of substrate slats for a phased array antenna, said antenna having a plurality of phase shifter elements for phase shifting and beam steering a radiated beam of the phased array antenna, said plurality of phase shifter elements interconnected with an interconnect structure comprising the plurality of substrate slats defining walls of the phased array antenna, said method comprising the steps of:

starting with a metal substrate;

applying a first dielectric layer to the metal substrate in selected areas;

applying metal bias/control circuitry to selected areas on the first dielectric layer;

applying a second dielectric layer over the bias/control circuitry;

applying a shielding metal layer over the second dielectric layer;

connecting circuit terminations to the metal bias/control circuitry for controls signal and bias voltages and to the shielding metal layer for a ground connection;

attaching a respective one of the plurality of phase shifter elements to each of the substrate slats;

connecting the respective phase shifter element to the circuit terminations; and connecting additional circuit terminations to the metal bias/control circuitry and the shielding metal layer.

13. The method of claim 12 further comprising the step of selecting as said respective phase shifter element an analog phase shifter from the group consisting of an MMIC FET, varactor, ferrite microstrip, ferro microstrip, ferrite stripline, ferro stripline, EMXT sidewall, reciprocal ferrite, ferroelectric, and latching ferrite.

14. The method of claim 12 further comprising the step of forming a connection between the shielding layer and the metal substrate with a path through the first dielectric layer and the second dielectric layer.

15. The method of claim 12 further comprising the step of locating the circuit terminations on the same side of each of the substrate slats as the metal bias/control circuitry.

16. The method of claim 12 further comprising the step of locating the circuit terminations on a side opposite of the metal bias/control circuitry on each of the substrate slats.

17. The method of claim 12 further comprising the step of attaching the respective phase shifter element to each of the substrate slats by solder bump connections to the circuit terminations.

18. The method of claim 12 further comprising the steps of attaching the respective phase shifter element to each of the substrate slats with a bonding method and making wirebond connections to the circuit terminations.

19. The method of claim 12 further comprising the step of selecting as said respective phase shifter element a digital phase shifter from the group consisting of a true time delay device, MEMS switched line, high pass/low pass, reflection, reactive loaded line and a latching ferrite.

* * * * *